US005223474A

United States Patent [19]

Usui

[11] Patent Number: 5,223,474

[45] Date of Patent: Jun. 29, 1993

[54] HEAT TRANSFER DYE-PROVIDING MATERIAL

[75] Inventor: Hideo Usui, Kanagawa, Japan

[73] Assignee: Fuji Photo Film Co., Ltd., Kanagawa, Japan

[21] Appl. No.: 850,814

[22] Filed: Mar. 13, 1992

[30] Foreign Application Priority Data

Mar. 15, 1991 [JP] Japan ..... 3-74423
Nov. 13, 1991 [JP] Japan ..... 3-323994

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,724,228 2/1988 Hann ..... 503/227

*Primary Examiner*—B. Hamilton Hess

*Attorney, Agent, or Firm*—Sughrue, Mion, Zinn, Macpeak & Seas

[57] ABSTRACT

A heat transfer dye-providing material comprising (a) a support, and (b) at least one dye-providing layer on one surface of the support, wherein the heat transfer dye-providing material has a surface layer in contact with an image-receiving material during heat transfer which surface layer contains a polymer comprising a repeating unit represented by formula (I);

(I)

wherein $R_f$ represents an alkyl group substituted by at least one chlorine atom and at least one fluorine atom; R represents a hydrogen atom or a methyl group; and n represents an integer of from 5 to 1,000.

5 Claims, No Drawings

HEAT TRANSFER DYE-PROVIDING MATERIAL

FIELD OF THE INVENTION

The present invention relates to a heat transfer dye-providing material for heat transfer recording and, in particular to a heat transfer dye-providing material capable of preventing the occurrence of discrepancies, creases, and other transferred image problems caused by the shifting and creasing of a heat transfer dye-providing material and a heat transfer image-receiving material when carrying out a heat transfer by superposing the heat transfer dye-providing material on the heat transfer-receiving material by increasing the friction force between the dye-providing material and the image-receiving material to improve close contact of both materials.

BACKGROUND OF THE INVENTION

Recently, with the rapid progress in the information industry, various information processing systems have been developed, and a recording method and apparatus suitable for the various information processing systems have been developed and practically employed.

One such information recording method is a heat transfer recording method, and the apparatus used for the recording method has the advantages of being lightweight, compact and noiseless. Further, the apparatus is excellent in operability and maintenance, and color images can be easily recorded. The heat transfer recording method has recently been widely used.

The heat transfer recording method is generally classified into a heat melting type recording method and a heat shifting recording method.

In the latter method, a heat transfer dye-providing material having a dye-providing layer containing a binder and a heat shifting dye on a support is superposed on a heat transfer image-receiving material, and heat is applied in a pattern to the assembly from the support side of the dye-providing material. The heat shifting dye is transferred and heated in a pattern onto the recording medium (the heat transfer image-receiving material) to form transferred images.

In addition, the heat shifting dye used in the heat shifting method is a dye which can be transferred from a heat transfer dye-providing material to a heat transfer image-receiving material by sublimation or diffusion in a medium.

However, the heat transfer dye-providing material used for the heat shifting type heat transfer recording method has the following problem. For forming multicolor images, usually transfers three successive times using heat transfer sheets of 3 color, i.e., yellow, magenta, and cyan, is required, for one multicolor image. Three dye transfer sheets having a yellow dye transfer portion, a magenta dye transfer portion, and a cyan dye transfer portion, respectively are prepared. Each dye transfer sheet is superposed on one image-receiving sheet followed by heating by a thermal head. The above procedure is carried out three times to form a multicolor image.

In this case, a problem occurs in that contact between the dye-providing sheet and the image-receiving sheet is insufficient so when they are moved in the superposed state for heating, these sheets are shifted from each other. It has been found that this is caused by a deficiency in friction between the surface of the dye-containing layer of the dye-providing sheet and the image-receiving surface of the image-receiving sheet in contact with each other. Hence the aforesaid problem can be solved by increasing the friction force between both sheets.

Thus, various investigations were made on various additives etc., and surface forms of the sheets for increasing the friction force, but it was difficult to obtain the necessary friction force without deteriorating the transferring property or forming undesirable influences on color images, and yet avoid side effects such as welding of the sheets, etc.

SUMMARY OF THE INVENTION

An object of the present invention is, therefore, to prevent the occurrence of shifting a heat transfer dye-providing material and an image-receiving material upon transferring images, by increasing the friction force between the heat transfer dye-providing material and the image-receiving material without deterioration of the transferring property, bad influences on color images formed, and side effects such as welding, etc.

It has now been discovered that the above-described object can be achieved by the present invention as described below.

To achieve the above objects, the present invention provides a heat transfer dye-providing material comprising (a) a support, and (b) at least one dye-providing layer on one surface of the support, wherein the heat transfer dye-providing material has a surface layer in contact with an image-receiving material during heat transfer which surface layer contains a material capable of increasing the friction coefficient between the heat transfer dye-providing material and the image-receiving material, and as a preferred embodoment, provides a heat transfer dye-providing material comprising (a) a support, and (b) at least one dye-providing layer on one surface of the support, wherein the heat transfer dye-providing material has a surface layer in contact with an image-receiving material during heat transfer which surface layer contains a polymer comprising a repeating unit represented by formula (I);

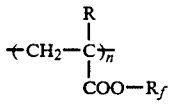

(I)

wherein $R_f$ represents an alkyl group substituted by at least one chlorine atom and at least one fluorine atom; R represents a hydrogen atom or a methyl group; and n represents an integer of from 5 to 1,000.

DETAILED DESCRIPTION OF THE INVENTION

The present invention is described in detail below.

The surface layer in contact with an image-receiving material during heat transfer genrally corresponds to a dye-providing layer. When a protective layer is provided on the dye-providing layer, the surface layer corresponds to the protective layer.

In the present invention, the material capable of increasing the friction coefficient is any material that when incorporated in the surface layer of a heat transfer dye-providing material in contact with an image-receiving material, that is, the dye-containing layer of the heat transfer dye-providing material or a protective layer formed on the dye-containing layer, the friction with an image-receiving material is increased at least 10%, and preferably increased at least 20% greater than the friction coefficient in the case where the material is not present. The measurement of the friction coefficient is described in Example 1.

The friction coefficient between the heat transfer dye-providing material and the image-receiving material is preferably from 1.9 to 2.4.

In the present invention, the amount of the material for increasing the friction coefficient is from 0.1 mg/m$^2$ to 100 mg/m$^2$, preferably from 0.5 mg/m$^2$ to 30 mg/m$^2$, and particularly preferably from 3 mg/m$^2$ to 20 mg/m$^2$.

In a preferred embodiment of this invention, the polymer comprising the repeating unit represented by formula (I) is used as the material for increasing the friction coefficient.

The polymer comprising the repeating unit shown by formula (I) is explained in greater detail below.

In formula (I), $R_f$ represents an alkyl group substituted by at least one chlorine atom and at least one fluorine atom, and the alkyl group may be a straight chain or branched group and is preferably the alkyl group shown by the following group;

$$-C_p(Cl)_q(F)_r(H)_s$$

p, q, and r each is an integer of 1 or more, s is an integer of 0 or more, and $2p+1=q+r+s$. Also, p is preferably an integer of from 1 to 20 and more preferably an integer of from 4 to 10, q is preferably an integer of from 1 to less than p, and r is preferably an integer of from 1 to 2p.

In formula (I), R represent a hydrogen atom or a methyl group, and n represents an integer of from 5 to 1,000, and preferably from 10 to 1,000.

The polymer for use in the present invention is a polymer comprising the repeating unit shown by formula (I). The polymer may be a homopolymer of the unit shown by formula (I) or may be a copolymer comprising at least two kinds of the units shown by formula (I). Furthermore, the polymer may be a copolymer of the repeating unit shown by formula (I) and other repeating units.

Other repeating units forming the copolymer include a repeating unit provided by a fluorine-substituted or unsubstituted alkyl ester of acrylic acid or methacrylic acid. When the polymer for use in the present inventoin is a copolymer of the repeating unit shown by formula (I) and another repeating unit, the content of the repeating unit shown by formula (I) is preferably from 5 to 95 mol %, and particularly preferably from 10 to 95 mol %.

The homopolymer or copolymer of the repeating unit shown by formula (I) for use in the present inventoin is obtained (i) by polymerizing a monomer synthesized by the esterification reaction of an acrylic acid or methacrylic acid compound and a chloro-fluorinated alkyl alcohol or (ii) by polymerized a mixture of the foregoing monomer and a monomer obtained by the esterification reaction of a fluorinated alkyl alcohol and acrylic acid or methacrylic acid or a mixture of the foregoing monomer and a monomer obtained by an esterification reaction of an alcohol and acrylic acid or methacrylic acid. Furthermore, the polymer for use in the present invention can be obtained (iii) by a method of polymerizing an acrylic acid or methacrylic acid monomer and then esterifying the pendant COOH in the polymer and a chloro-fluorinated alkyl alcohol by a high molecular reaction.

Specific examples of the repeating unit shown by formula (I) for use in the present invention are illustrated below, but the invention is not limited to these units.

$$\left(CH_2-\underset{\substack{|\\ COOCF_2CF_2Cl}}{CH}\right)_n \quad (1)$$

$$\left(CH_2-\underset{\substack{|\\ COOCF_2CF_2CF_2Cl}}{CH}\right)_n \quad (2)$$

$$\left(CH_2-\underset{\substack{|\\ COOCCl_2CF_2CF_3}}{CH}\right)_n \quad (3)$$

$$\left(CH_2-\underset{\substack{|\\ COOCF_2CF_2CF_2CF_2Cl}}{CH}\right)_n \quad (4)$$

$$\left(CH_2-\underset{\substack{|\\ COOCH_2CF_2CF_2CF_2Cl}}{CH}\right)_n \quad (5)$$

$$\left(CH_2-\underset{\substack{|\\ COOCH_2CF_2CF_2CF_2CF_2Cl}}{CH}\right)_n \quad (6)$$

$$\left(CH_2-\overset{\substack{CH_3\\ |}}{\underset{\substack{|\\ COOCF_2CF_2Cl}}{C}}\right)_n \quad (7)$$

$$\left(CH_2-\overset{\substack{CH_3\\ |}}{\underset{\substack{|\\ COOCF_2CF_2CF_2Cl}}{C}}\right)_n \quad (8)$$

$$\left(CH_2-\overset{\substack{CH_3\\ |}}{\underset{\substack{|\\ COOCH_2CF_2CF_2Cl}}{C}}\right)_n \quad (9)$$

$$\left(CH_2-\overset{\substack{CH_3\\ |}}{\underset{\substack{|\\ COOCCl_2CF_2CF_3}}{C}}\right)_n \quad (10)$$

$$\left(CH_2-\overset{\substack{CH_3\\ |}}{\underset{\substack{|\\ COO(CF_2)_5CF_2Cl}}{C}}\right)_n \quad (11)$$

$$\left(CH_2-\overset{\substack{CH_3\\ |}}{\underset{\substack{|\\ COO(CF_2)_6CF_2Cl}}{C}}\right)_n \quad (12)$$

$$\left(CH_2-\overset{\substack{CH_3\\ |}}{\underset{\substack{|\\ COOCCl_2(CF_2)_5CF_3}}{C}}\right)_n \quad (13)$$

$$\left(CH_2-\overset{\substack{CH_3\\ |}}{\underset{\substack{|\\ COOCCl_2(CF_2)_5CF_2H}}{C}}\right)_n \quad (14)$$

-continued (15)

$$\left(CH_2-\underset{\underset{COOCCl_2(CF_2)_6CF_3}{|}}{\overset{\overset{CH_3}{|}}{C}}\right)_n$$

(16)

$$\left(CH_2-\underset{\underset{COO(CF_2)_8CF_2Cl}{|}}{\overset{\overset{CH_3}{|}}{C}}\right)_n$$

(17)

$$\left(CH_2-\underset{\underset{COO(CF_2)_8CF_2Cl}{|}}{CH}\right)_x\left(CH_2-\underset{\underset{COOC_2H_5}{|}}{CH}\right)_y$$

x: y = about 90:10 (mol ratio)

(18)

$$\left(CH_2-\underset{\underset{COO(CF_2)_6CF_2Cl}{|}}{CH}\right)_x\left(CH_2-\underset{\underset{COOC_3H_7}{|}}{CH}\right)_y$$

x: y = about 90:10 (mol ratio)

(19)

$$\left(CH_2-\underset{\underset{COOCH_2CF_2CF_2Cl}{|}}{\overset{\overset{CH_3}{|}}{C}}\right)_x\left(CH_2-\underset{\underset{COOC_3H_7}{|}}{CH}\right)_y$$

x: y = about 90:10 (mol ratio)

Among them, the repeating units (1) to (10) are especially preferred.

In the present invention, the amount of the polymer of formula (I) is from 0.1 mg/m$^2$ to 100 mg/m$^2$, preferably from 0.5 mg/m$^2$ to 30 mg/m$^2$, and particularly preferably from 3 mg/m$^2$ to 20 mg/m$^2$.

The polymer comprising the repeating unit shown by formula (I) is commercially available. For example, Asahi Guard AG 660 (trade name, made by Asahi Glass Co., Ltd.), which is a commercially available material of the aforesaid polymer, has excellent properties, and by controlling the amount thereof present, the friction coefficient can be increased at least 50% more than when the material is not present.

Conventional supports such as a polyethylene terephthalate film, a polyamide film, a polycarbonate film, a glassine paper, a condenser paper, cellulose ester paper, a fluorine polymer film, a polyether film, a polyacetal film, a polyolefin film, a polyimide film, a polyphenylene sulfide film, a polypropylene film, a polysulphone paper, a cellophane paper, etc. can be used as the support for the heat transfer dye-providing material.

The support for the heat transfer dye-providing material generally has a thickness of from 2 μm to 30 μm, and if necessary, the material may contain a subbing layer.

The heat transfer dye-providing material using a heat shifting dye basically has a dye-providing layer containing a dye which becomes movable by heat and a binder on a support. The heat transfer dye-providing material is obtained by preparing a coating composition by dissolving or dispersing a conventionally known dye which sublimes to becomes movable by heat and a binder resin in a proper solvent and coating the coating composition on one surface of the support at a dry thickness of from about 0.2 μm to 5 μm, and preferably from 0.4 μm to 2 μm followed by drying to form a dye-providing layer.

The dye-providing layer may be formed as a single layer, but in the case of multiple use, it may be formed of two or more layers. In the latter case, the content of the dye and the ratio of dye/binder may differ in each layer.

Any dyes which are conventionally used for heat transfer dye-providing materials can be used as the dye forming the dye-providing layer. The particularly preferred dyes in the present invention have a molecular weight of from about 150 to about 800. The dye is preferably selected by considering the transferring temperature, the hue, the light fastness, the solubility in an ink or a binder resin, the dispersibility, etc., in the present invention.

Specific examples of the dyes include dispersion dyes, basic dyes, oil-soluble dyes, etc. In particular, Sumikalon Yellow E4GL (trade name, made by Sumitomo Chemical Company, Limited), Dianix Yellow H2G-FS (trade name, made by Mitsubishi Kasei Corporation), Miketon Polyerter Yellow 3GSL (trade name, made by Mitsui Toatsu Chemicals, Inc.), Kayaset Yellow 937 (trade name, made by Nippon Kayaku Co., Ltd.), Sumikalon Red EFBL (trade name, made by Sumitomo Chemical Company, Limited), Dianix Red ACE (trade name, made by Mitsubishi Kasei Corporation), Miketon Polyerter Red FB (trade name, made by Mitsui Toatsu Chemicals, Inc.), Kayaset Red 126 (trade name, made by Nippon Kayaku Co., Ltd.), Miketon Fast Brilliant Blue B (trade name, made by Mitsui Toatsu Chemicals, Inc.), Kayaset Blue 136 (trade name, made by Nippon Kayaku Co., Ltd.), etc., are suitably used in the present invention.

In the present invention, yellow dyes shown by the following formula (Y) are preferably used.

(Y)

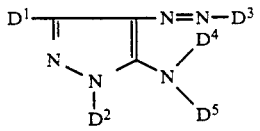

$D^1$ represents a hydrogen atom, an alkyl group, an alkoxy group, an aryl group, an alkoxycarbonyl group, a cyano group, or a carbamoyl group; $D^2$ represents a hydrogen atom, an alkyl group, or an aryl group; $D^3$ represents an aryl group or a heteryl group (heterocyclic group); and $D^4$ and $D^5$ each represents a hydrogen atom or an alkyl group, each group described above may be substituted.

Specific examples of the yellow dye which can be preferably used in the present invention are illustrated below, but the invention is not limited to these examples.

Y-1

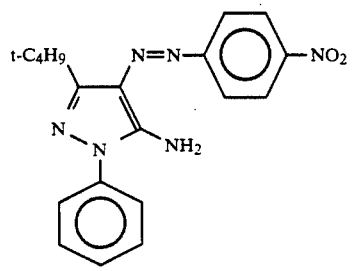

-continued
Y-2
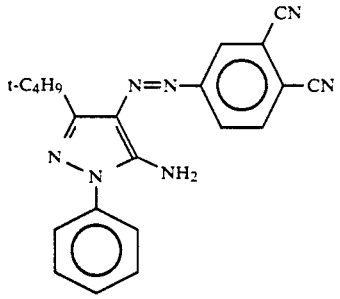
Y-3
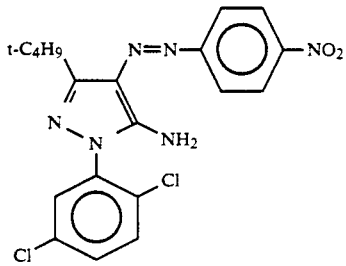
Y-4
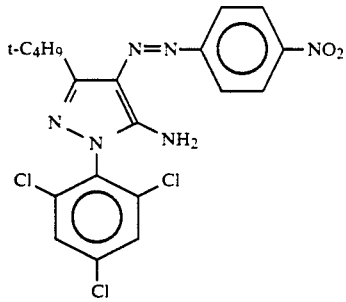
Y-5
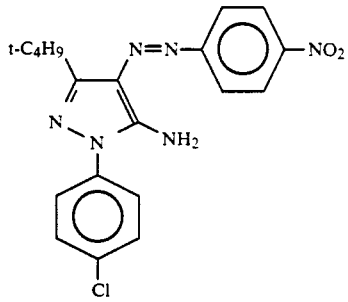
Y-6
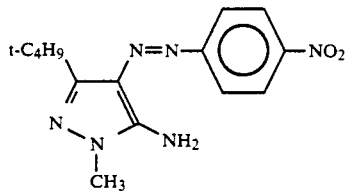
Y-7
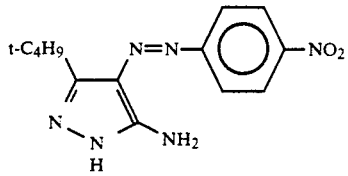
-continued
Y-8
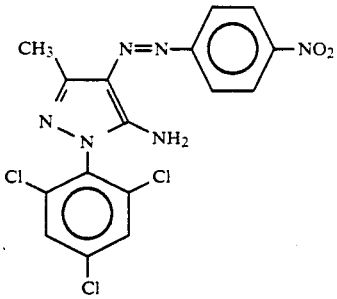
Y-9
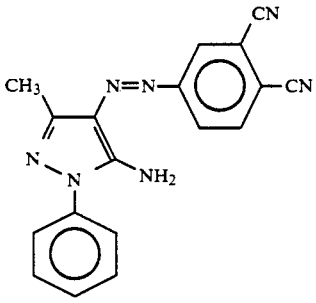
Y-10
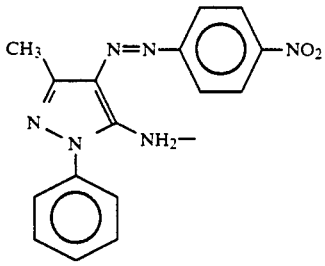
Y-11
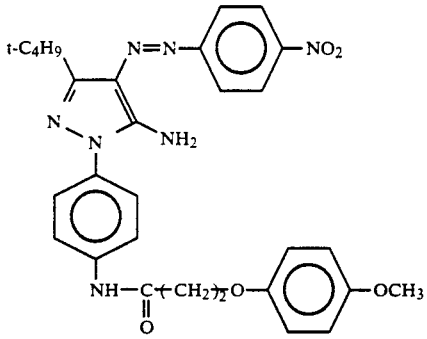
In the present invention, magenta dyes shown by the following formula (M) are preferably used.
(M)
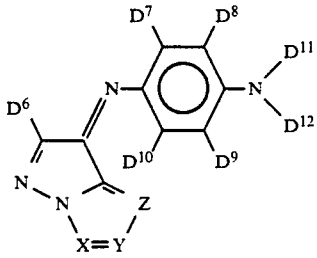
wherein $D^6$ to $D^{10}$ each represents a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^{11}$ and $D^{12}$ each represents a hydrogen atom, an alkyl group, or an aryl group; $D^{11}$ and $D^{12}$ may combine with each other to form a ring, and $D^{8}$ and $D^{11}$ and/or $D^{9}$ and $D^{12}$ may combine with each other to form a ring. X, Y and Z each represents $=C(D^{13})-$ or a nitrogen atom ($D^{13}$ represents a hydrogen atom, an alkyl group, an aryl group, an alkoxy group, an aryloxy group, or an amino group), when X and Y are $=C(D^{13})-$ or Y and Z are $=C(D^{13})-$, two $D^{13}$s may combine with each other to form a saturated or unsaturated carbon ring, and each group described above may be substituted.

Specific examples of the magenta couplers which can be preferably used in the present invention are illustrated below, but the invention is not limited to these examples.

M-1

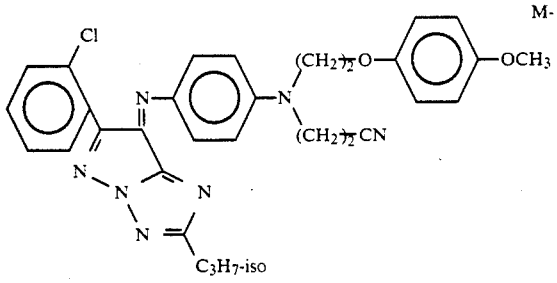

M-2

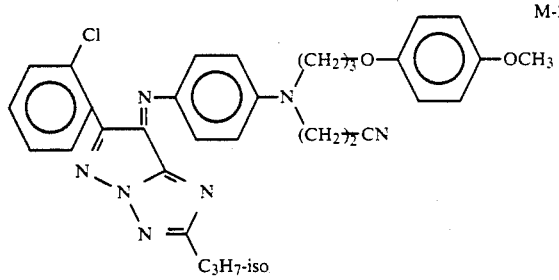

M-3

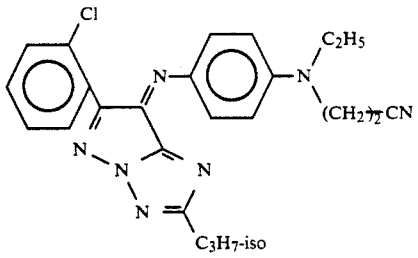

M-4

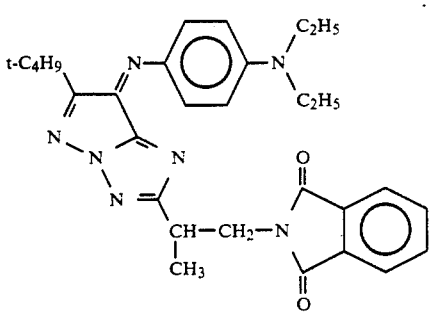

-continued

M-5

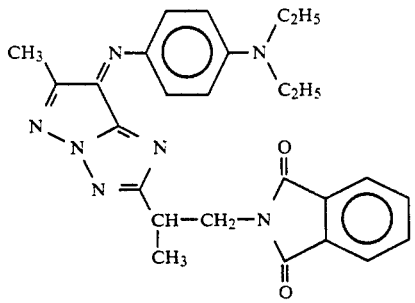

M-6

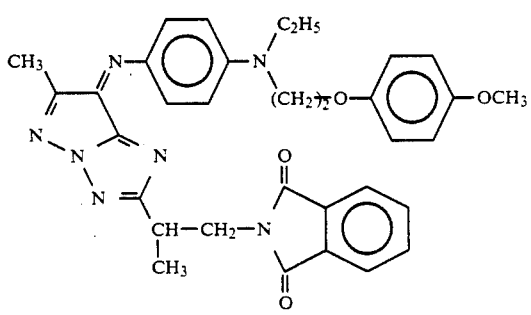

M-7

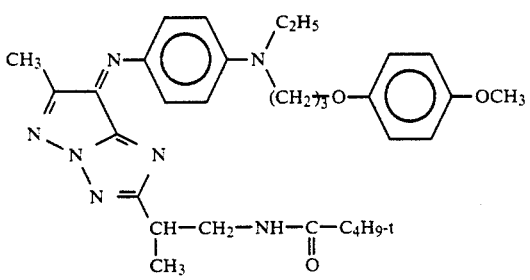

M-8

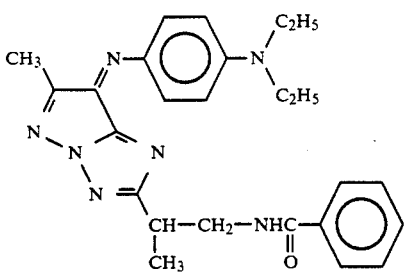

M-9

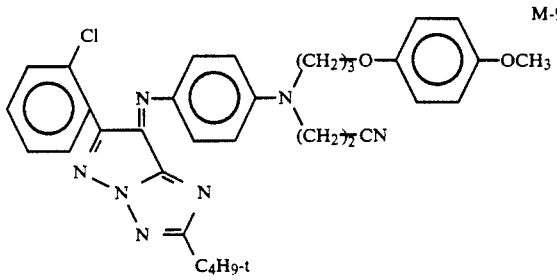

-continued

M-10

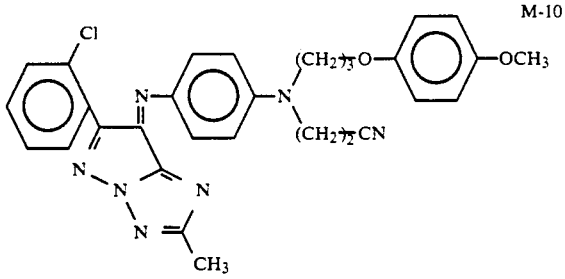

In the present invention, cyan couplers shown by the following formula (C) are preferably used.

(C)

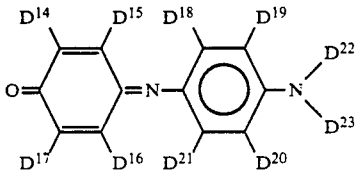

$D^{14}$ to $D^{21}$ have the same meaning as $D^6$ to $D^{10}$ in formula (M) described above and $D^{22}$ and $D^{23}$ have the same meaning as $D^{11}$ and $D^{12}$ in formula (M) described above.

Specific examples of cyan couplers, which are preferably used in the present inventoin, are illustrated below, but the invention is not limited to these examples.

C-1

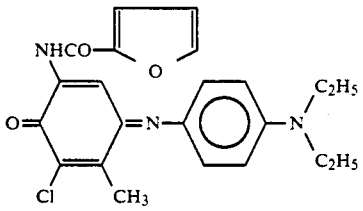

C-2

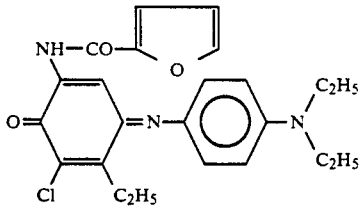

C-3

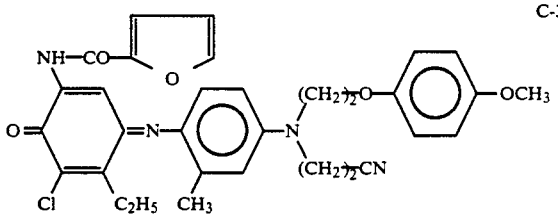

C-4

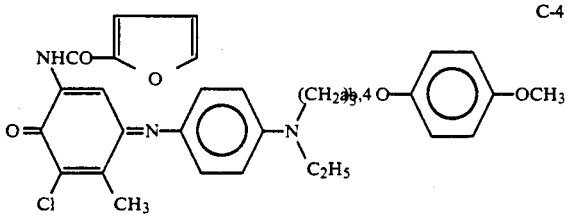

-continued

C-5

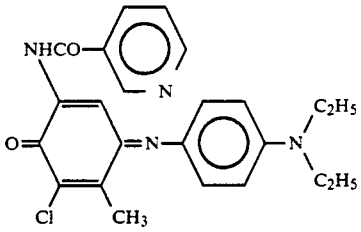

C-6

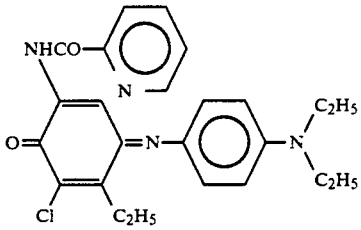

C-7

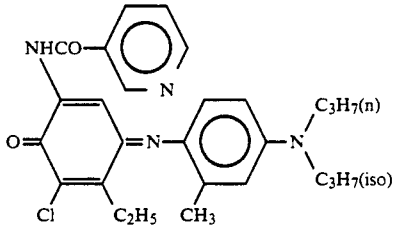

C-8

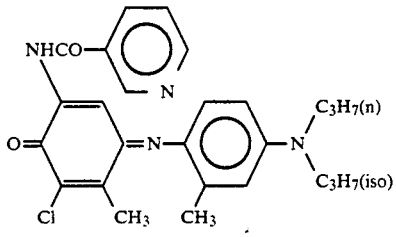

C-9

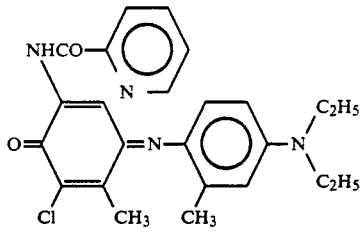

In the compounds shown by formulae (Y), (M), and (C), it is preferred to add the fading inhibitor described in Japanese Patent Application 1-271078, which improves the light fastness of the color images.

Also, as a binder resin for use with the foregoing dyes, a conventional binder resin can be used, and usually a binder resin, which has a high heat resistance and does not hinder shifting of the dye when heated, is preferably used.

For example, polyamide resins, polyester resins, epoxy resins, polyurethane resins, polyacrylic resins (e.g., polymethyl methacrylate, polyacrylamide, and polystyrene-2-acrylonitrile), vinyl resins such as polyvinyl pyrrolidone, etc., polyvinyl chloride resins (e.g., a vinyl chloride-vinyl acetate copolymer), polycarbonate resins, polystyrene, polyphenylene oxide, cellulose resins (e.g., methyl cellulose, ethyl cellulose, carboxymethyl cellulose, cellulose acetate hydrogen phthalate, cellulose acetate, cellulose acetate propionate, cellulose acetate butyrate, and cellulose triacetate), polyvinyl alcohol resins (e.g., polyvinyl alcohol and partially saponificated polyvinyl alcohol such as polyvinyl butyral, etc.), petroleum resins, rosin derivatives, coumarone-indene resins, terpene series resins, and polyolefin series resins (e.g., polyethylene and polypropylene) are used.

It is preferred that the amount of such a binder resin used in the resin is from about 80 to 600 parts by weight per 100 parts by weight of a dye.

In the present invention, as an ink solvent for dissolving or dispersing the foregoing dye and binder resin, conventional ink solvents can be used.

For a dye-providing layer, the dye is selected such that an image having a desired hue can be transferred to an image-receiving layer and, if necessary, two or more dye-providing layers each having a different hue may be formed side by side on one heat transfer dye-providing material. For example, when images such as a natural color photograph are formed by repeating a print of each color according to the signal of each separated color, it is preferred that each printed color is cyan, magenta, and yellow. In this case, three dye-providing layers, each having such a hue are formed side by side. Furthermore, a dye-providing layer containing a dye having a black hue may be added to the above-described three dye-providing layers. In addition, in this case, it is preferred to provide a mark for detecting a position simultaneously with the formation of either dye-providing layer in the case of forming these dye-providing layers since inks and printing steps other than needed for the formation of dye-providing layers are not required.

In the present invention, as the support for the heat transfer image-receiving material, any supports which can withstand the transfer temperature and meet the requirements with respect to smoothness, whiteness, slidability, friction, antistatic property, non-denting after transfer, etc., can be used. For example, paper support such as a synthetic paper (e.g., polyolefin synthetic papers and polystyrene synthetic papers), a wood free paper, an art paper, a coated paper, a cast coated paper, a wall paper, a lining paper, a paper impregnated with a synthetic resin or an emulsion, a paper sized with a synthetic resin, a paper board, a cellulose fiber paper, a polyolefin-coated paper (in particular, paper both layers of which are coated with polyethylene), etc.; films or sheets of various kinds of plastics such as polyolefins, polyvinyl chloride, polyethylene terephthalate, polystyrene methacrylate, polycarbonate, etc.; the foregoing films or sheets subjected to a treatment if imparting white light reflectivity; and laminates of the foregoing supports can be used.

The heat transfer image-receiving layer has an image-receiving layer formed on the support. The image-receiving layer is preferably a coated layer having a thickness of from about 0.5 μm to 50 μm and containing a material capable of receiving a heat shifting dye shifted from the heat dye-providing material during printing and dyeing the heat shifting dye alone or together with a binder.

Typical examples of the material capable of receiving the heat shifting dye are the following resins.

(a) Resins having an ester bond:

There are polyester resins obtained by the condensation of a dicarboxylic acid component such as terephthalic acid, isophthalic acid, succinic acid, etc., (the dicarboxylic acid component may be substituted by a sulfonic acid group, a carboxy group, etc.) and ethylene glycol, diethylene glycol, propylene glycol, neopentyl glycol, bisphenol A, etc.; polyacrylic acid ester resins or polymethacrylic acid ester resins such as polymethyl methacrylate, polybutyl methacrylate, polymethyl acrylate, polybutyl acrylate, etc.; polycarbonate resins, polyvinyl acetate resins; styreneacrylate resins, vinyltoluene acrylate resins, etc. Specific examples of these resins are described in JP-A-59-101395, JP-A-63-7971, JP-A-63-7972, JP-A-63-7973, and JP-A-60-294862.

Also, as commercially available products, Vylon 290, Vylon 200, Vylon 280, Vylon 300, Vylon 103, Vylon GK-140 and Vylon GK-130 (trade names, made by Toyobo Co., Ltd.) and ATR-2009 and ATR-2010 (trade names, made by Kao Corporation) can be used.

(b) Resins having a urethane bond:

Examples include polyurethane resins, etc.

(c) Resins having an amido bond:

Examples include polyamide resins, etc.

(d) Resins having a urea bond:

Examples include resins, etc.

(e) Resins having a sulfone bond:

Examples include polysulfone resins, etc.

(f) Other resins having a high polar bond:

Examples include polycaprolactone resins, styrene-maleic anhydride resins, polyvinyl chloride resins, polyacrylonitrile resins, etc.

In addition to the aforesaid synthetic resins, mixtures of them and copolymers of the monomers in the about described resins can be also used.

The heat transfer image-receiving material can contain, particularly in the image-receiving layer, a high-boiling organic solvent or a thermal solvent as a material capable of receiving a heat shifting dye or a diffusion aid for the dye.

Specific examples of the high-boiling organic solvent and the thermal solvent include the compounds described in JP-A-62-174754, JP-A-62-245253, JP-A-61-209444, JP-A-61-200538, JP-A-62-8145, JP-A-62-9348, JP-A-62-30247 and JP-A-62-136646.

In the present invention, the image-receiving layer of the heat transfer image-receiving material may comprise a water-soluble binder having dispersed therein the material capable receiving the heat shifting dye. As the water-soluble binder being use in this case, various water-soluble polymers can be used, but a water-soluble polymer having a group capable of causing a cross-linking reaction with a hardening agent is preferred, and gelatins are particularly preferred.

The image-receiving layer may comprise two or more layers. In this case, it is preferred that for the layer near the support, a synthetic resin having a low glass transition point is used, or a high-boiling organic solvent or a thermal solvent is used to increase the dyeing property for the dye, and for the outermost layer, a synthetic resin having a high glass transition point is used, and the amount of a high-boiling organic solvent or a thermal solvent is reduced as small as possible or no such solvent is used to present the occurrence of problems such as becoming sticky on the surface, sticking of the surface to other materials, the retransfer of the dye to other materials after transferring of the dye, blocking the heat transfer dye-providing material, etc.

Also, it is preferred to add squalane to the surface layer of the heat transfer image-receiving layer brought into contact with the dye-providing material at the heat transfer to prevent the image-receiving material from welding to the dye-providing material by heat.

The total thickness of the image-receiving layer(s) is preferably from 0.5 μm to 50 μm, and particularly preferably from 3 μm to 30 μm. In the case of a double layer structure, the thickness of the outermost layer is preferably from 0.1 μm to 2 μm, and particularly preferably from 0.2 μm to 1 μm.

In the present invention, the heat transfer image-receiving material may have an interlayer between the support an the image-receiving layer.

The interlayer is a layer which has a function as a cushion layer, a porous layer, a dye diffusion preventing layer or has two or more such functions and may also function as an adhesive, depending on the materials constituting the interlayer.

The dye diffusion preventing layer prevents the heat shifting dye from diffusing into the support. As the binder for the diffusion preventing layer, a water-soluble binder or an organic solvent-soluble binder may be used, but a water-soluble binder is preferred. As examples thereof, the water-soluble binders described above as the binder for the image-receiving layer are preferably used, and gelatin is particularly preferred.

The porous layer is a layer which prevents the heat applied during heat transfer from diffusing from the image-receiving layer to the support to effectively utilize the applied heat.

In the present invention, the image-receiving layer, cushion layer, porous layer, diffusion preventing layer, adhesive layer, etc., of the heat transfer image-receiving material may contain a fine powder of silica, clay, talc, diatomaceous earth, calcium carbonate, calcium sulfate, barium sulfate, aluminum silicate, a synthetic zeolite, lead oxide, lithopone, titanium oxide, alumina, etc.

The heat transfer image-receiving material may further contain a brightening agent. Examples thereof include the compounds described in K. Veenkataraman, *The Chemistry of Synthetic Dyes,* Vol V, Chapter 8 and JP-A-61-143752. More practically, there are stilbene compounds, coumarin compounds, biphenyl compounds, benzoxazolyl compounds, naphthalimide compounds, pyrazoline compounds, carbostiril compounds, 2,5-dibenzoxazole thiophene compounds, etc.

The brightening agent can be used as a combination with a fading inhibitor.

The layers of the heat transfer dye-providing material and the heat transfer image-receiving material in the present invention may be hardened by a hardening agent.

In the case of hardening polymers soluble in an organic solvent, the hardening agents described in JP-A-61-199997 and JP-A-58-215398 can be used. Also, for a polyester resin, an isocyanate series hardening agent is particularly preferably used.

For hardening water-soluble polymers, the use of the hardening agents described in U.S. Pat. No. 4,678,739, column 41, JP-A-59-116655, JP-A-62-245261, and JP-A-61-18942 is suitable. Specific examples also include aldehyde hardening agents (e.g., formaldehyde), aziridine hardening agents, epoxy hardening agents, vinylsulfone hardening agents [e.g., N,N'-ethylene-bis(-vinylsulfonylacetamido)ethane], N-methylol hardening agents (e.g., dimethylolurea), and high molecular weight hardening agents (e.g., the compounds described in JP-A-62-234157).

For the heat transfer dye-providing material and the heat transfer dye-receiving material, a fading inhibitor may be used. As the fading inhibitor, there are, for example, antioxidants, ultraviolet absorbents, and certain kinds of metal complexes.

For example, chroman compounds, coumaran compounds, phenol compounds (e.g., hindered phenols), hydroquinone derivatives, hindered amine derivatives, and spiroindane compounds can be used as the anti-oxidant. Also, the compounds described in JP-A-61-159644 are effective.

Benzotriazole compounds (described in U.S. Pat. No. 3,533,794, etc.), 4-thiazolidane compounds (described in U.S. Pat. No. 3,352,681, etc.), benzophenone compounds (described in JP-A-56-2784, etc.), and other compounds described in JP-A-54-48535, JP-A-62-136641, and JP-A-61-88256 are examples of the ultraviolet absorbent. Also, the ultraviolet absorptive polymers described in JP-A-62-260152 are effective.

Examples of the metal complex are the compounds described in U.S. Pat. Nos. 4,241,155, 4,245,018, columns 3 to 36, 4,245,195, columns 3 to 8, JP-A-62-174741, JP-A-61-88256, pages 27 to 29, JP-A-1-75568 and JP-A-63-199248.

Examples of the useful fading inhibitor are described in JP-A-62-215272, pages 125–137.

The fading inhibitor for preventing fading of the dye transferred onto the image-receiving material may be incorporated into the image-receiving material or may be supplied from outside to the image-receiving material by a method of transferring it from the dye-providing material.

The foregoing antioxidant, ultraviolet absorbent, and metal complex may be used in combination For the layers of the heat transfer dye-providing material and the heat transfer image-receiving material various surface active agents may be used for the purposes of a coating aid, peeling improvement, sliding improvement, static prevention, development acceleration, etc.

Nonionic surface active agents, anionic surface active agents, amphoteric surface active agents, and cationic surface active agents can be used as the surface active agent. Specific examples of the these surface active agents are described in JP-A-62-173463 and JP-A-62-183457.

Also, for dispersing the material capable of receiving the heat shifting dye, the releasing agent, the fading inhibitor, the ultraviolet absorbent, the brightening agent, and other hydrophobic compounds in the water-soluble binder, it is preferred to use a surface active agent as the dispersion aid. In addition to the above-described surface active agents, the surface active agents described in JP-A-59-157636, pages 37–38 are particularly preferably used.

For the heat transfer dye-providing material and the heat transfer image-receiving material, a matting agent can be used. Silicon dioxide, the compounds described in JP-A-61-88256, page 29, such as polyolefin, polymethacrylate, etc., and the compounds described in JP-A-63-274944 and JP-A-63-274952, such as benzoguanamine resin beads, polycarbonate resin beads, AS resin beads, etc. can be used as the matting agent.

As described above, the dye-providing material of the present invention is used for forming transferred images. In such a process, the dye-providing material may be imagewise heated using a laser, and dye images are transferred onto the image-receiving material to form transferred images.

The dye-providing material of the present invention is used in the form of a sheet, a continuous roll, or ribbon. In the case of use as a continuous roll or a ribbon, the roll or the ribbon has only one kind of dye or different regions each having a different dye, such as the regions of, for example, cyan, magenta, yellow dyes, black dyes and other dyes.

That is, the dye-providing material of one color, two colors, three colors, or four colors (or more colors) is included in the scope of the present invention.

The invention is explained in more detail by the following practical examples, but the invention is not limited to these examples. In the following examples, all parts, unless otherwise indicated, are by weight.

EXAMPLE 1

Preparation of Heat Transfer Dye-Providing Material

A heat resisting lubricious layer composed of a thermosetting acrylic resin was formed on one surface of a polyester film (made by Teijin Limited) of 6 μm in thickness, and the dye-providing layer-forming inks having the following compositions were coated on the opposite surface of the polyester film support to the surface having the lubricious layer with a wire bar in the order of a black marking layer, a yellow dye-providing layer, a magenta dye-providing layer, and a cyan dye-providing layer followed by drying to provide Sample 101.

| | |
|---|---|
| Ink for Black Marking Layer: | |
| XEL Detecting Mark Chinese Ink (made by Morohoshi Printing Ink Co., Ltd.) | 100 g |
| XEL Hardening Agent (D) (trade name, made by Morohoshi Printing Ink Co., Ltd.) | 4 g |
| Methyl Ethyl Ketone | 40 g |
| Toluene | 40 g |
| Dry Coated Amount | 1.2 g/m$^2$ |
| Ink for Yellow Dye-Providing Layer: | |
| Dye Y-1 | 4 parts |
| Polyvinyl Butyral Resin (Denka Butyral 5000A, trade name, made by Denki Kagaku Kogyo K.K.) | 3 parts |
| Polyisocyanate (Takenate D110N, trade name, made by Takeda Chemical Industries, Ltd.) | 0.1 part |
| Methyl Ethyl Ketone | 50 parts |
| Toluene | 50 parts |
| Dry Coated Amount | 1.2 g/m$^2$ |
| Ink for Magenta Dye-Providing Layer: | |
| Dye M-2 | 3 parts |
| Polyvinyl Butyral resin (Denka-Butyral 5000A, trade name, made by Denki Kagaku Kogyo K.K.) | 3 parts |
| Methyl Ethyl Ketone | 50 parts |
| Toluene | 50 parts |
| Dry Coated Amount | 1.2 g.m$^2$ |
| Ink for Cyan Dye-Providing Layer: | |
| Dye C-5 | 3 parts |
| Polyvinyl Butyral Resin (Denka Butyral 5000A, trade name, made by Denki Kagaku Kogyo K.K.) | 3 parts |
| Polyisocyanate (Takenate D110N, trade name, made by Takeda Chemical Industries, Ltd.) | 0.1 part |
| Methyl Ethyl Ketone | 50 parts |
| Toluene | 50 parts |
| Dry Coated Amount | 1.2 g/m$^2$ |

Preparation of Heat Transfer Image-Receiving Material

Low-density polyethylene having kneaded therein titanium oxide and ultramarine blue was laminated on one surface of a wood free paper of 175 μm in thickness as a support at a thickness of 33 μm and high-density polyethylene was laminated on the opposite surface at a thickness of 32 μm to provide a polyethylene-coated paper.

Then, Coating Composition (1) for a hydrophilic binder layer was coated on the low-density polyethylene laminated side at a gelatin coverage of 1 g/m$^2$.

| Coating Composition (1) for Hydrophilic Binder Layer: | |
|---|---|
| Gelatin | 60 g |
| Water | 3,000 g |
| Surface Active Agent (shown below) | 2.3 g |

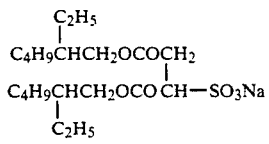

| | |
|---|---|
| Thickener (potassium polystyrene-sulfonate) | 1.4 g |

Furthermore, Coating Composition (2) for an image-receiving layer having the following composition was coated on the hydrophilic binder layer at a polyester coverage of 10 g/m$^2$ by a GieBer (die) coating followed by drying to provide a heat transfer image-receiving material. In this case, drying was carried out in an oven of 100° C. for 30 minutes after natural drying under a flow of air.

| Coating Composition (2) for Image-Receiving Layer: | |
|---|---|
| Polyester Resin (1)* | 20 g |
| Polyisocyanate (KP-90, trade name, Dainippon Ink and Chemicals, Inc.) | 3 g |
| Amino-Denatured Silicone Oil (KF-857, trade name, made by Shin-Etsu Silicone K.K.) | 0.5 g |
| Matting Agent (Floor Beads CL 2086, trade name, made by Sumitomo Seika K.K.) | 0.01 g |
| Methyl Ethyl Ketone | 100 ml |
| Toluene | 100 ml |

*The composition (mol %) of the foregoing polyester resin (1) is shown in Table A below.

TABLE A

| Polyester Resin (1) Composition (mol %) | | | | | Molecular |
|---|---|---|---|---|---|
| TPA | IPA | SIPA | BIS-A-ED | EG | Weight |
| 25 | 25 | 1 | 24.5 | 24.5 | about 20,000 |

In the above table:
TPA = Terephthalic Acid
IPA = Isophthalic Acid

SIPA =

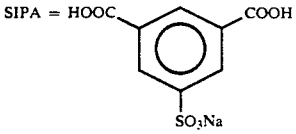

BIS-A-ED =

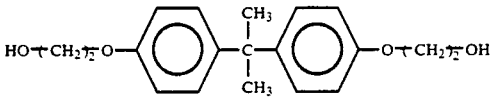

In Sample No. 101, Asahi Guard AG660 (trade name, made by Asahi Glass Co. Ltd.) was added to the yellow dye-producing ink, the magenta dye-providing ink and cyan dye-providing ink in an amount shown in the following table to providing Samples Nos. 102 to 106.

| Sample No. | Yellow Ink Amount of AG660 (wt. part) | Magenta Ink Amount of AG660 (wt. part) | Cyan Ink Amount of AG660 (wt. part) |
|---|---|---|---|
| 101 | — | — | — |
| 102 | 0.02 | 0.02 | 0.02 |
| 103 | 0.04 | 0.04 | 0.04 |
| 104 | 0.08 | 0.08 | 0.08 |
| 105 | 0.16 | 0.16 | 0.16 |
| 106 | 0.32 | 0.32 | 0.32 |

Sample No. 101: comparison sample.
Sample Nos. 102 to 106: samples of the invention.

Measurement of Friction Coefficient

Each coated surface of the yellow dye-providing layer, the magenta dye-providing layer and the cyan dye-providing layer of each of Sample Nos. 101 to 106 was superposed on the image-receiving sheet, a weight $W_0$ was placed thereon, the sample was pulled in the horizontal direction, the force $W_1$ required in this case was measured, and the friction coefficient $W_1/W_0$ was determined (under a temperature of 25° C. and a relative humidity of 50%).

The results obtained are shown in Table 3.

Evaluation of Uneven Transfer

An image pattern having densities of 8 stages in each of yellow, magenta, cyan, blue, green, red, and black colors was prepared by a personal computer and dye image transfer was carried out by a video printer VP 7100 (trade name, made by Fuji Photo Film Co., Ltd.) using each sample and the above-described image-receiving material. The occurrence of color discrepancy of the image formed and the crease thereof were evaluated.

The results are shown in the following table.

| Sample No. | Friction Coefficient ($W_1/W_0$) Y | M | C | Discrepancy of image | Occurrence of Creases |
|---|---|---|---|---|---|
| 101 | 1.5 | 1.5 | 1.5 | discrepancy of 5 mm or more | 2 sheets creased per 10 sheets |
| 102 | 1.7 | 1.7 | 1.8 | discrepancy of 0.3 mm | 1 sheet creased per 10 sheets |
| 103 | 1.9 | 2.0 | 2.0 | none | 0/10 sheets |
| 104 | 2.1 | 2.2 | 2.2 | none | 0/10 sheets |
| 105 | 2.2 | 2.3 | 2.3 | none | 0/10 sheets |
| 106 | 2.3 | 2.3 | 2.4 | none | 0/10 sheets |

As shown in the above table, it can be clearly seen that the samples of the present invention (102 to 106) show excellent effects and the friction coefficient is high as compared with the comparison sample (101) to greatly reduce the occurrence of image difficulties that is discrepancy in the images and the occurrence of creases.

EXAMPLE 2

Preparation of Heat Transfer Dye-Providing Material

A heat resisting lubricious layer composed of a thermosetting acrylic resin was formed on one surface of a polyester film (made by Teijin Limited) of 6 μm in thickness and the dye-providing layer forming inks having the following compositions were coated on the opposite surface of the polyester film support to the lubricious layer side in the order of a black marking layer, a yellow dye-providing layer, a magenta dye-providing layer, and a cyan dye-providing layer with a wire bar followed by drying to provide Sample No. 201.

| | |
|---|---|
| Ink for Black Marking Layer: | |
| XEL Detecting Mark Chinese Ink (made by Morohoshi Printing Ink Co., Ltd.) | 100 g |
| XEL Hardening Agent (D) (made by Morohoshi Printing Ink Co., Ltd.) | 4 g |
| Methyl Ethyl Ketone | 40 g |
| Toluene | 40 g |
| Dry Coated Amount | 1.2 g/m² |
| Ink for Yellow Dye-Providing Layer: | |
| Dye Y-1 | 4 parts |
| Polyvinyl Butyral Resin (Denka Butyral 5000A, trade name, made by Denki Kagaku Kogyo K.K.) | 2.5 parts |
| Polyvinyl Butyral Resin (Denka Butyral 3000-1, trade name, made by Denki Kagaku Kogyo K.K.) | 0.5 part |
| Polyisocyanate (Takenate D110N, trade name, made by Takeda Chemical Industries, Ltd.) | 0.1 part |
| Silicone Oil (KF 96, trade name, made by Shin-Etsu Silicone K.K.) | 0.05 part |
| Methyl Ethyl Ketone | 50 parts |
| Toluene | 50 parts |
| Dry Coated Amount | 1.2 g/m² |
| Ink for Magenta Dye-Providing Layer: | |
| Dye M-2 | 3 parts |
| Polyvinyl Butyral Resin (Denka Butyral 5000A, trade name, made by Denki Kagaku Kogyo K.K.) | 2.5 parts |
| Polyvinyl Butyral Resin (Denka Butyral 3000-1, trade name, made by Denki Kagaku Kogyo K.K.) | 0.5 part |
| Polyisocyanate (Takenate D110N, trade name, made by Takeda Chemical Industries, Ltd.) | 0.1 part |
| Silicone Oil (KF 96, trade name, made by Shin-Etsu Silicone K.K.) | 0.05 part |
| Methyl Ethyl Ketone | 50 parts |
| Toluene | 50 parts |

-continued

| | |
|---|---|
| Dry Coated Amount | 1.2 g/m$^2$ |
| Ink for Cyan Dye-Providing Layer: | |
| Dye C-5 | 3 parts |
| Polyvinyl Butyral Resin (Denka Butyral 5000A, trade name, made by Denki Kagaku Kogyo K.K.) | 2.5 parts |
| Polyvinyl Butyral Resin (Denka Butyral 3000-1, trade name, made by Denki Kagaku Kogyo K.K.) | 0.5 part |
| Polyisocyanate (Takenate D110N, trade name, made by Takeda Chemical Industries, Ltd.) | 0.1 part |
| Silicone Oil (KF 96, trade name, made by Shin-Etsu Silicone K.K.) | 0.05 part |
| Methyl Ethyl Ketone | 50 parts |
| Toluene | 50 parts |
| Dry Coated Amount | 1.2 g/m$^2$ |

In Sample No. 201, by adding the polymer containing fluorine and chlorine for use in the present inventoin to each of the ink for the yellow dye-providing layer, the ink for the magenta dye-providing layer, and the ink for the cyan dye-providing layer in the amounts shown in Table B below, Sample Nos. 202 to 214 were prepared.

In addition, the polymerization degrees (n) of the polymers for use in the present inventoin were 50 in Compounds (1) to (4), 200 in Compounds (5) to (7), and 100 in Compounds (8) to (10).

TABLE B

| Sample No. | Yellow Ink Compound No. | Yellow Ink Amount (wt. part) | Magenta Ink Compound No. | Magenta Ink Amount (wt. part) | Cyan Ink Compound No. | Cyan Ink Amount (wt. part) |
|---|---|---|---|---|---|---|
| 201 | — | — | — | — | — | — |
| 202 | (1) | 0.08 | (1) | 0.08 | (1) | 0.08 |
| 203 | " | 0.08 | " | 0.08 | " | 0.06 |
| 204 | " | 0.16 | " | 0.16 | " | 0.16 |
| 205 | (2) | 0.08 | (2) | 0.08 | (2) | 0.08 |
| 206 | (3) | 0.16 | (3) | 0.16 | (3) | 0.16 |
| 207 | (4) | 0.16 | (4) | 0.16 | (4) | 0.16 |
| 208 | (5) | 0.16 | (5) | 0.16 | (5) | 0.16 |
| 209 | (6) | 0.20 | (6) | 0.16 | (6) | 0.16 |
| 210 | (1) | 0.08 | (2) | 0.08 | (3) | 0.16 |
| 211 | (7) | 0.08 | (7) | 0.08 | (7) | 0.08 |
| 212 | (8) | 0.12 | (8) | 0.12 | (8) | 0.12 |
| 213 | (9) | 0.16 | (9) | 0.16 | (9) | 0.16 |
| 214 | (10) | 0.16 | (10) | 0.16 | (10) | 0.16 |

By using each of the heat transfer dye-providing materials and the heat transfer image-receiving material as described in Example 1, the dye image transfer was carried out as in Example 1, and the friction coefficient and the uneven transfer were measured in the same manner as in Example 1.

The results obtained are shown in Table C below.

TABLE C

| Sample No. | Friction Coefficient ($W_1/W_0$) Y | M | C | Discrepancy of image | Occurrence of Creases |
|---|---|---|---|---|---|
| 201 | 1.5 | 1.5 | 1.5 | discrepancy of 5 mm or more | 2 sheets creased per 10 sheets |
| 202 | 2.1 | 2.2 | 2.2 | none | 0/10 sheets |
| 203 | 2.1 | 2.2 | 2.0 | none | 0/10 sheets |
| 204 | 2.2 | 2.3 | 2.3 | none | 0/10 sheets |
| 205 | 2.1 | 2.1 | 2.1 | none | 0/10 sheets |
| 206 | 2.2 | 2.2 | 2.3 | none | 0/10 sheets |
| 207 | 2.1 | 2.2 | 2.3 | none | 0/10 sheets |
| 208 | 2.2 | 2.1 | 2.2 | none | 0/10 sheets |
| 209 | 2.2 | 2.1 | 2.3 | none | 0/10 sheets |
| 210 | 2.1 | 2.0 | 2.3 | none | 0/10 sheets |

TABLE C-continued

| Sample No. | Friction Coefficient ($W_1/W_0$) Y | M | C | Discrepancy of image | Occurrence of Creases |
|---|---|---|---|---|---|
| 211 | 2.1 | 2.1 | 2.2 | none | 0/10 sheets |
| 212 | 2.2 | 2.3 | 2.3 | none | 0/10 sheets |
| 213 | 2.3 | 2.2 | 2.3 | none | 0/10 sheets |
| 214 | 2.3 | 2.3 | 2.4 | none | 0/10 sheets |

Sample 201: comparison sample.
Samples 202 to 214: samples of the invention.

As shown in Table C, it can be seen that the samples of the present invention show excellent effects that the friction coefficient becomes high as compared with the comparison example greatly reducing the occurrence of discrepancy and the occurrence of creases in the images.

As described above, by using the heat transfer dye-providing material containing a polymer having fluorine and chlorine in the surface layer being brought into contact with an image-receiving material at heat transfer, the friction force between the heat transfer dye-providing material and the image-receiving material can be increased to prevent the occurrence of color discrepancy in the color images and creases therein during heat transfer without accompanied by deterioration of the transferring property, undesirable influences on the color images, and side effects such as welding, etc.

While the invention has been described in detail and with reference to specific embodiments thereof, it will be apparent to one skilled in the art that various changes and modifications can be made therein without departing from the spirit and scope thereof.

What is claimed is:

1. A heat transfer dye-providing material comprising (a) support, and (b) at least one dye-providing layer on one surface of the support, wherein the heat transfer dye-providing material has a surface layer in contact with an image-receiving material during heat transfer which surface layer contains a polymer comprising a repeating unit represented by formula (I);

$$\left(CH_2-\underset{\underset{COO-R_f}{|}}{\overset{\overset{R}{|}}{C}}\right)_n \qquad (I)$$

wherein $R_f$ represents an alkyl group substituted by at least one chlorine atom and at least one fluorine atom; R represents a hydrogen atom or a methyl group; and n represents an integer of from 5 to 1,000.

2. A heat transfer dye-providing material as in claim 1, wherein $R_f$ in formula (I) is an alkyl group shown by the following formula;

$$-C_p(Cl)_q(F)_r(H)_s$$

wherein p, q, and r each represents an integer of at least 1, s represents an integer of 0 or more, and $2p+1$ is $q+r+s$.

3. A heat transfer dye-providing material as in claim 2, wherein p is an integer of from 1 to 20, q is an integer of from 1 to less than p, and r is an integer of from 1 to 2p.

4. A heat transfer dye-providing material as in claim 1, wherein the amount of the polymer comprising a repeating unit represented by formula (I) is from 0.1 mg/m$^2$ to 100 mg/m$^2$.

5. A heat transfer dye-providing material as in claim 1, wherein n represents an integer of from 10 to 1000.

* * * * *